US008157095B2

(12) United States Patent
Motsch

(10) Patent No.: US 8,157,095 B2
(45) Date of Patent: Apr. 17, 2012

(54) FLEXIBLE PACKAGE WITH TEARING MEANS

(75) Inventor: Andreas Peter Motsch, Waldems (DE)

(73) Assignee: The Procter & Gamble Company, Cincinnati, OH (US)

( * ) Notice: Subject to any disclaimer, the term of this patent is extended or adjusted under 35 U.S.C. 154(b) by 418 days.

(21) Appl. No.: 12/423,166

(22) Filed: Apr. 14, 2009

(65) Prior Publication Data

US 2009/0257689 A1 Oct. 15, 2009

(30) Foreign Application Priority Data

Apr. 14, 2008 (EP) ..... 08103521

(51) Int. Cl.
*B65D 85/00* (2006.01)
*B65D 33/00* (2006.01)

(52) U.S. Cl. ..... 206/494; 206/440; 383/207

(58) Field of Classification Search ..... 206/233, 206/440, 494; 383/7, 8, 10, 120, 207
See application file for complete search history.

(56) References Cited

U.S. PATENT DOCUMENTS 4,890,934 A * 1/1990 Feaver et al. ..... 383/10
4,934,535 A * 6/1990 Muckenfuhs et al. ..... 206/494
5,036,978 A * 8/1991 Frank et al. ..... 206/494
5,050,742 A * 9/1991 Muckenfuhs ..... 206/494
5,163,558 A * 11/1992 Palumbo et al. ..... 206/494
5,219,229 A * 6/1993 Sengewald ..... 383/10
5,282,687 A 2/1994 Yee
5,464,285 A * 11/1995 Anderson ..... 383/10
5,897,542 A * 4/1999 Lash et al. ..... 604/378
6,095,686 A * 8/2000 Mohrmann ..... 383/8
7,168,563 B2 * 1/2007 Zander et al. ..... 206/440
7,213,710 B2 * 5/2007 Cotert ..... 206/494
7,866,473 B2 * 1/2011 Clark et al. ..... 206/494
2002/0112982 A1 * 8/2002 Stagray et al. ..... 206/494
2006/0021894 A1 2/2006 Clark et al.

OTHER PUBLICATIONS

International Search Report.

* cited by examiner

*Primary Examiner* — Bryon Gehman
(74) *Attorney, Agent, or Firm* — William E. Gallagher

(57) ABSTRACT

The invention refers to a flexible package comprising a plurality of walls including first and second opposing side walls having side seams. At least a first gusset is formed in at least the first side wall, the first gusset comprising an internal panel and an external panel together forming a pocket. At least the first side wall comprises lines of weakness which are at least partially formed in or through the external panel. The lines of weakness are adapted to create an opening in the first side wall.

11 Claims, 9 Drawing Sheets

FLEXIBLE PACKAGE WITH TEARING MEANS

FIELD OF THE INVENTION

The object of the application relates to a package suitable as a flexible wrapping especially for diapers that are placed in the package in a consolidated form in one or more series. An opening can be made in one side wall of the package manually for individual removal of the package contents.

BACKGROUND OF THE INVENTION

A flexible package with an opening feature is disclosed e.g. in US 2006/0021894 A1. The opening feature is facilitated in a side wall and, upon opening, provides access to the articles contained in the package. The opening can be initiated by using an aperture. The package will tear open along lines of weakness. The lines of weakness extend to an upper edge of the package, while the aperture is arranged somewhat below this edge. Upon opening, the complete aperture is torn downwardly.

One of the disadvantages associated with this package is that it can accidentally tear if it is lifted at the external panel of a gusset. Moreover, the contents contained in the package will easily fall out of the package upon opening, as the opening provided is relatively large.

It is an objective of the present invention, to provide an opening feature for a flexible package, which does not open inadvertently upon a lifting of the package.

Further, it is an objective of the present invention to provide a package with an opening feature, wherein the articles or parts of the articles contained in the package do not fall out of the package after opening but are contained in the package. For example, if the articles are a multiplicity of diapers, the diapers should not fall out of the package after opening.

SUMMARY OF THE INVENTION

The present invention provides a flexible package being capable and being adapted to contain a multiplicity of articles. The package comprises a plurality of walls, including first and second opposing side walls. Each of the side walls has side seams and each of the side walls has an upper and a lower edge.

At least a first gusset is formed in at least the first side wall, whereby the first gusset comprises an internal panel and an external panel, together forming a pocket.

The at least first side wall further comprises a tearing means being at least partially formed in or through the external panel.

The tearing means is adapted to create an opening in the first side wall. The opening is confined by at least an upper section of the internal panel and by at least a lateral section of the side wall.

At least one lateral edge of the upper section of the internal panel is at least partially bonded to an upper edge of the lateral section of the side wall. Further, the lateral section and the upper section form a frame, which is adapted to retain the articles inside the package after creation of the opening.

The present invention further provides a method of manufacturing a flexible package comprising a plurality of walls, including first and second opposing side walls, wherein at least a first gusset is formed in the first side wall and wherein the first gusset comprises an internal panel being covered by an external panel, together forming a pocket. Further, the first side wall comprises a tearing means being at least partially formed in or through the external panel. The method of manufacturing comprises the steps of:

Providing an endless sheet travelling in a machine direction and comprising in cross machine direction a twofold portion and a fourfold portion. The twofold portion comprises two layers and the fourfold portion comprises four layers. The outer layers of the fourfold portion extend into the two layers of the twofold portion. Further, at least one line of weakness is introduced in each layer of the fourfold portion. The line of weakness forms a tearing means being adapted to provide an opening in the side wall. The opening is confined by at least an upper section of the internal panel and by at least a lateral section of the side wall. The upper and lateral sections form a frame, which is adapted to retain the articles inside the package after creation of the opening.

Further, at least one outer layer of the fourfold portion is at least partially bonded with an adjacent inner layer of the fourfold portion for generating the frame.

Finally, all layers of the twofold and fourfold portion are seamed and cut along a side seam extending in cross machine direction.

BRIEF DESCRIPTION OF THE DRAWINGS

While the specification concludes with claims pointing out and distinctly claiming the present invention, it is believed the same will be better understood by the following drawings taken in conjunction with the accompanying specification, wherein like components are given the same reference number.

DETAILED DESCRIPTION OF THE INVENTION

Figure 1:
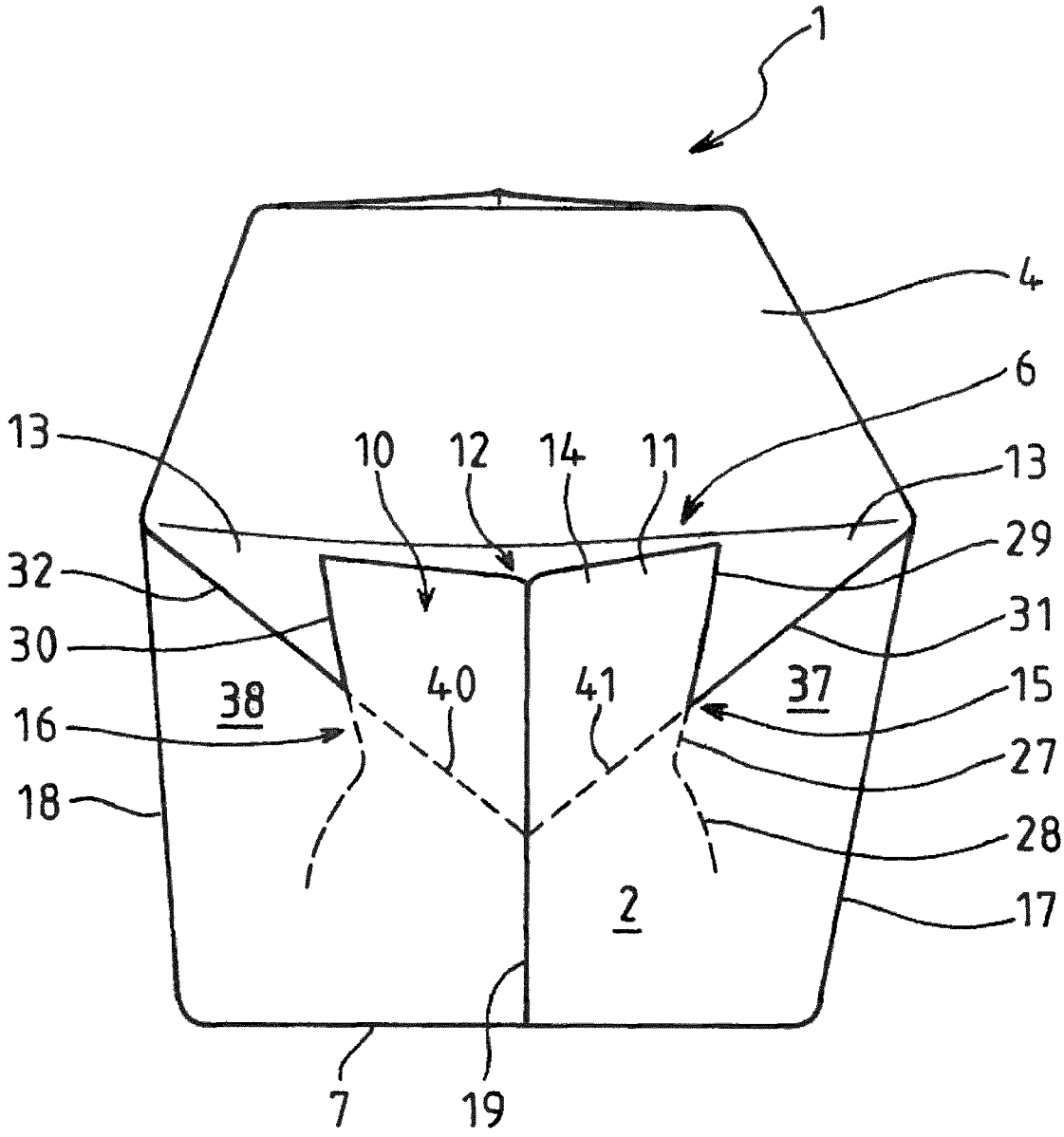
FIG. 1 in a perspective view, a foil package containing a series of diapers, with a first side wall comprising opening means having a line of weakness along a tearing-off direction and comprising a tongue- or flap-like appendix for creating an opening in the wall.

"Diaper" as used herein refers to absorbent articles generally worn by infants and incontinent persons about the lower torso. The diaper may be fastened onto the wearer using tapes or, alternatively, the diaper may have side seams, which are fastened together—both permanently or refastenably—such that the diaper is applied onto the wear like a conventional underwear (i.e. the user will put his legs through the respective leg openings and the diaper is then pulled up to its final position).

"Comprise," "comprising," and "comprises" is an open ended term that specifies the presence of what follows, e.g. a component but does not preclude the presence of other features, elements, steps or components known in the art, or disclosed herein. However, the presence of additional other features, elements, steps or components is not required at the terms "comprise" "comprising," and "comprises" thus also encompasses the terms "consisting of" and "essentially consisting of".

The flexible package 1 of the present invention may be rectangular, and may comprise thermoplastic material. Further, the flexible package 1 comprises a plurality of walls, typically two opposing, first and second side walls 2, 3, a front wall, a back wall as well as a top wall 4 an a bottom wall.

Each side wall 2, 3 has an upper edge 6, 8 lying adjacent a top wall 4 and further has a lower edge 7, 9 lying adjacent the bottom wall of the package 1. Each side wall 2, 3 also has two opposing side edges 17, 18 lying adjacent the front and back wall of the package, respectively.

The material of the filled package 1 is folded over from the front and back wall to the side walls 2, 3 of the package 1. Also, the material at least from the top wall 4 is folded over to the side walls 2, 3. However, also the material from the bottom wall may be folded over to the side walls 2, 3. Each side wall 2, 3 comprises a respective side seam 19, 39 to provide a closed package 1. The side seams 19, 39 are essentially extending from the upper edges 6, 8 of the side walls 2, 3 towards the lower edges 7, 9 of the side walls 2, 3.

Furthermore, at least one gusset 12 is formed in the first side wall 2 adjacent the upper edge 6 of the side wall 2. The gusset 12 comprises an internal panel 13, which is overlaid by an external panel 14. The internal panel 13 and the external panel 14 may have the same dimensions and the same shape and may therefore be coextensive. With respect to the embodiment of FIG. 1, the external panel 14 may be smaller in width than the internal panel 13 because parts of the external panel have been removed. In lateral extension along the upper edge 6 of the side wall 2, the internal panel 13 is at least partially covered by the external panel 14, e.g. in a region including the side seam 19.

The gusset 12 of the first side wall 2 may be at least partially shaped in the form of a triangle pointing down towards the lower edge 7 of the side wall 2. The gusset 12 formed by the internal panel 13 being at least partially overlapped by the external panel 14. The external panel 14 is two-ply and therefore comprises two layers of material being folded onto each other, the fold line extending adjacent the upper edge 6 of the side wall and defines the upper edge of the external panel 14.

The external panel 14 has lateral side edges 29, 30 which may extend substantially parallel to the side edges 17, 18 of the side wall 2. The upper edge of the external panel 14 may be smaller in width than the side wall 2. In such embodiments, the internal panel 13 is only partially overlaid by the external panel 14, for example in a region of the side wall comprising the side seam 19.

In FIG. 1 the lower end portions of the external panel 14 and of the gusset 12 are indicated by the dashed fold lines 40, 41, being symmetrically arranged with respect to the side seam 19 and extending into the side seam 19 at an angle of from 40° to 50°; or from 42° to 48° or 45°, upper edge 6 of the side wall 2.

The upper portion of the external panel 14 as illustrated in FIG. 1 provides a kind of tongue- or flap-like appendix serving as a tearing means 11. Hence, a user intending to open the package 1 may grasp the external panel 14 from above and/or from the side edges 29, 30 and may exert a tearing force directed towards the lower edge 7 of the side wall, thereby disrupting the internal panel 13 and possibly also the external panel 14 and forming an opening 35 for removing the articles being disposed inside the package 1.

The opening may form along at least one line of weakness 15, 16 extending in the side wall 2. There may be provided a first 15 and a second line of weakness 16, each of which extending adjacent the opening 35 to be created in the package 1 and serving as a weakened structure in the material of the package. The extension and shape of the lines of weakness 15, 16 define at least a part of the shape and geometry of the opening 35, because the lines of weakness 15, 16 after disruption of the material coincide with at least one edge of the opening 35. Additionally, there may be provided a third line of weakness 20 connecting the first and second line of weakness 15, 16 and extending in a portion of the internal panel 13 being covered or overlaid by the external panel 14.

The flexible package 1 may comprise a multiplicity of articles 33, 34. For example, the package 1 of the present invention may be used for accommodating a multiplicity of diapers. The diapers 33, 34 may be folded and the multiplicity of folded diapers may be arranged in one or more rows within the package.

A diaper typically has a longitudinal axis and a transverse axis. One end portion of the diaper is configured as a front waist region of the diaper. The opposite end portion is configured as a back waist region of the diaper. An intermediate portion of the diaper is configured as a crotch region, which extends longitudinally between the front and back waist regions. The crotch region is that portion of the diaper which, when the diaper is worn, is generally positioned between the wearer's legs. Further, the transverse axis is typically in the crotch region of the diaper.

In a two-folded diaper, the diaper is folded in the crotch region along its transverse axis or near its transverse axis. In the folded diaper, the front waist region is living adjacent the back waist region and the front and back waist region are substantially coextensive.

Alternatively, the diaper may be tri-folded, whereby one of the front or back waist regions is folded over onto the crotch region where after the remaining waist region is folded over onto the first folded waist region.

The folded diaper comprises two major surfaces. E.g. in a two-folded diaper, the first major surface comprises the front waist region of the diaper and a portion of the crotch region, while the second major surface comprises the back waist region of the diaper and the remaining portion of the crotch portion. However, also a tri-folded diaper has two major surfaces. When placed into the flexible package, the major surfaces should face towards the side walls 2 of the package 1.

If the package 1 comprises more than one row of diapers, the diapers should be arranged such that in each row, major surfaces 33, 34 face towards the side walls 2 of the package.

Also, the folded diapers arranged in the package 1 have an upper part lying towards the top wall of the package and a lower part lying towards the bottom wall.

Figure 2:
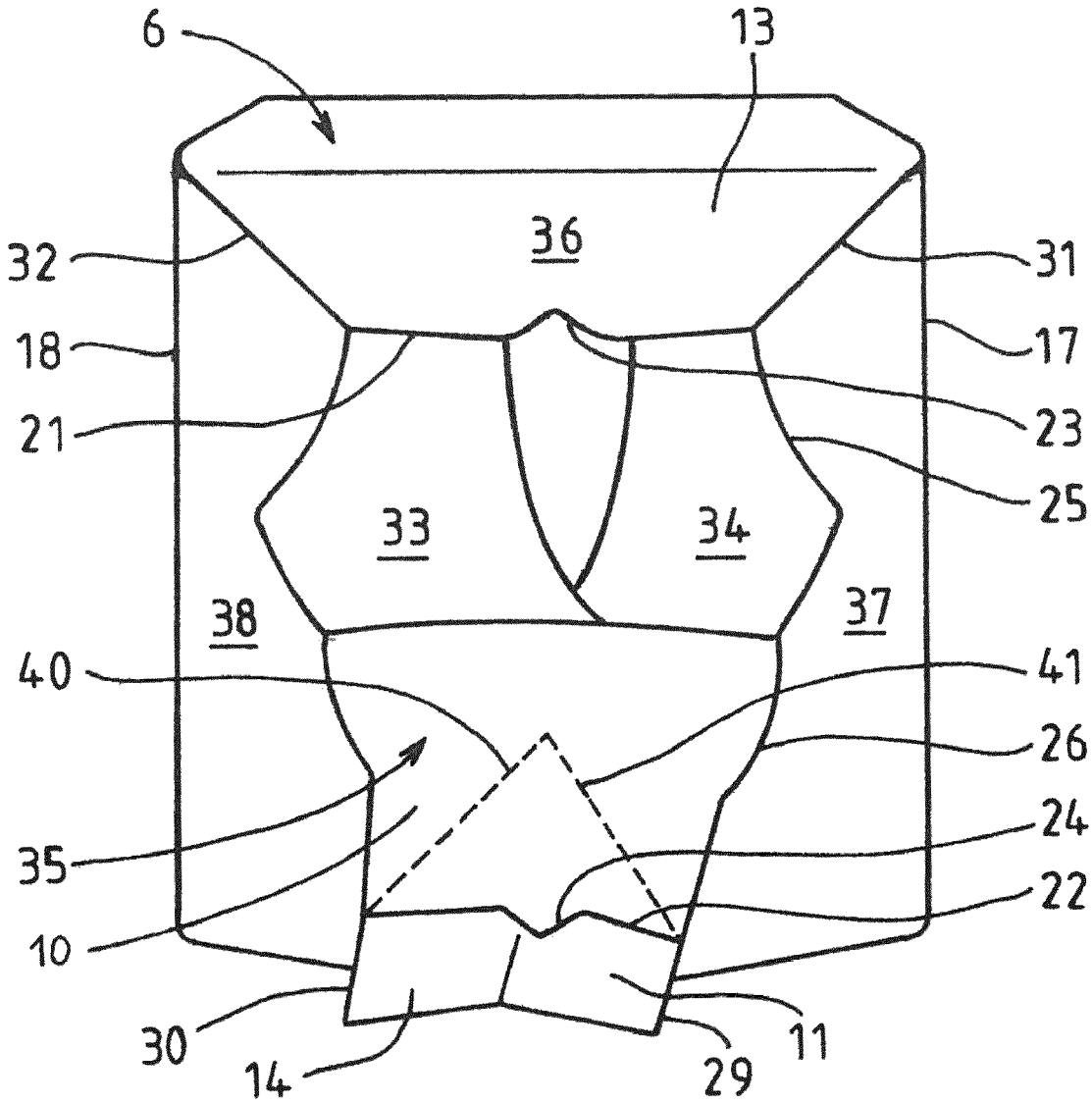
FIG. 2 in a perspective view, the package of FIG. 1, with the side wall opened.
Figure 3:
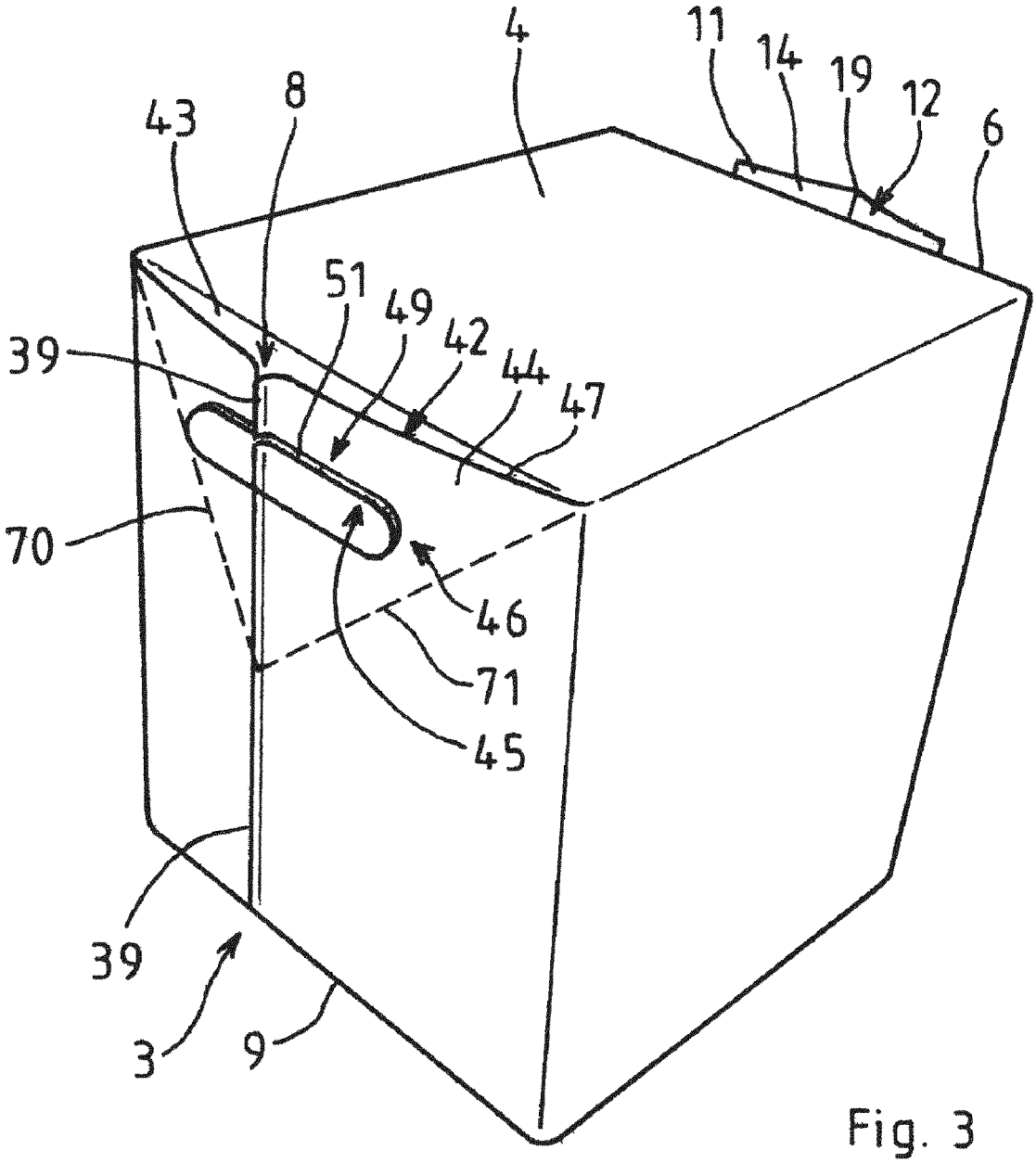
FIG. 3 in a perspective view, the package of FIG. 1 as seen from a second side wall comprising gripping means and a slit or aperture directly underneath a strap.

In the embodiment illustrated in FIGS. 1 to 3 only one side wall 2 comprises opening and tearing means whereas the other oppositely located side wall 3 comprises gripping means 45 for lifting and transporting the package 1. However, the gripping means is only optional.

The opening 35 may be created by tearing down the tearing means 11 or the tongue- or flap-like external panel 14. While the external panel 14 and the associated tearing means 11 are torn off or torn down, the various lines of weakness 15, 16, 20 are disrupted and become disassembled. The disruption of the various lines of weakness 15, 16, 20 leads to the creation of the opening 35 as depicted in FIG. 2. In the closed configuration the third line of weakness 20 separates the lower edge 21 of an upper section 36 of the internal panel 13 from the upper edge 22 of the internal panel 13. The third line of weakness 20 is part of the tearing means 11, which is torn down for creating the opening 35. In the following, the piece, which is torn down, will be referred to as tear-off portion 10. In a central section the edge 21 may comprise a notch 23 corresponding with a peak portion 24 of the edge 22 of the tearing means 11.

Further, the tear-off portion 10 also comprises a lateral side edge 26 which coincides with a side edge 25 of a lateral section 37 of the side wall 2. The same applies to the other lateral edge of the tear-off portion or the tearing means 11 having a lateral edge coinciding with an inner edge of a lateral section 38 of the side wall 2.

The opening 35 as illustrated in FIG. 2 is confined by an upper section 36 of the internal panel 13 and by at least one, typically by two lateral sections 37, 38 of the side wall 2. The two lateral sections 37, 38 may be symmetrically arranged. The upper and lateral section(s) 36, 37, 38 form a frame adapted to retain the articles, e.g. the diapers 33, 34 inside the package 1 after creation of the opening 35.

In the illustrated embodiments, the tear-off motion maybe directed downwards to the lower edge 7 of the side wall 2. In alternative embodiments, the opening 35 may also extend to other walls of the package 1. Then, at least a part of the tear-off portion 10 extends to one or more other walls, for instance to the front, back, top or bottom wall of the package 1. In these alternative embodiments, the opening 35 may be asymmetric in shape and may also be asymmetrically arranged with respect to the overall geometry and symmetry of the side wall 2.

In order to form a frame providing a retaining function for the articles 33, 34, at least one lateral edge of the upper section of the internal panel is at least partially bonded to an upper edge of the at least one lateral section 37, 38 of the side wall 2. In this way, a retaining frame comprising an upper section and at least one lateral section can be provided. In particular, after opening the package 1, the frame helps to ensure, that the articles 33, 34 comprised in the package 1 remain within the package 1 and do not fall out. The upper part of the articles, e.g. the diapers 33, 34, is maintained in the package 1 by the frame. In another embodiment the frame may comprise two lateral sections 37, 38, being at least partially bonded with the upper section 36. The upper section 36 then connects the two lateral sections 37, 38 and leading to a frame comprising three frame sections. The width of the opening 35 is governed by the lateral size and lateral extension of the lateral section 37, 38. The two lateral sections 37, 38 may further be symmetric in shape and geometry. Alternatively, their overall shape and lateral extension may vary. The spacing between the first and second lines of weakness 15, 16 and the width of the tear-off portion depends on the size of the articles 33, 34 to be disposed in the flexible package 1. Also, if for example the package 1 comprises a multiplicity of folded diapers 33, 34, the size of the opening 35 will also depend on the number of diaper rows comprised in the package 1. If the package 1 comprises only one row of diapers 33, 34, the spacing between the lines of weakness 15, 16 will typically be smaller compared to a package 1 comprising two rows of diapers arranged next to each other, as illustrated in FIG. 2. After opening the package 1, the first diaper 33, 34 of each row directly faces towards the opening 35 with one of its major surfaces.

The package 1 of the present invention may also contain three or four rows of articles, such as the diapers 33, 34. In embodiments comprising four rows of articles, two rows are arranged with one of their side portions next to each other while two more rows are arranged similarly below or above the first pair of rows. In these embodiments the tear-off portion, the tearing means 11 and associated first and second lines of weakness 15, 16 may extend further downward towards the lower edge 7 of the package 1. An opening 35 being smaller in width or height may be torn open first to have access to the upper two rows of diapers. After the upper two rows of diapers have been used up, the opening can be enlarged by exerting a further tear-off force to the tear-off portion in such a way, that also lower portions of the lines of weakness are disrupted and become disassembled along their entire length.

In such a final opening position, the two lower rows of diapers are securely held and maintained within the package 1 upon using the upper two rows of diapers. Alternatively, a package 1 containing four rows of diapers may comprise two separate lines of weakness, wherein the upper line of weakness may be associated with the tearing means 11. A lower and separate line of weakness may be implemented into the side wall 2 independently from the tearing means 11 and also independent and separate from the upper line of weakness.

If the package 1 comprises only one row of diapers, the spacing between laterally spaced lines of weaknesses 15, 16 confining the opening 35 to the left and to the right, may be smaller than the width of the article's major surface, which faces towards the opening 35. In this embodiment, after opening the package 1 along the lines of weakness 15, 16, one of the diaper's major surfaces faces towards the opening 35 and the side portions of the diaper's major surface may be retained in the package 1 by the lateral sections 37, 38 of the side wall 2, each of which extending from a line of weakness 16 to a side edge 18 and from a line of weakness 15 to the side edge 17 of the side wall 2, respectively.

If the package 1 comprises two rows of diapers 33, 34, the spacing between the lines of weakness 15, 16 will typically be smaller than the width of both rows of diapers 33, 34 taken together. However, the spacing between the first and second line of weakness 15, 16 may be larger than the width of a major surface of one diaper 33, 34. In this embodiment, after opening the package 1 along the lines of weakness 15, 16, the side portion of the diapers major surface lying adjacent the side edge 17, 18 of the side wall 2 and facing towards the opening 35 may be retained in the package 1 by the lateral sections 37, 38 of the side wall 2.

However, the other side portion of the diapers major surface lying adjacent a diaper 33, 34 of a neighbouring row of diapers may be retained in the package 1 mainly due to friction forces between the diapers 33, 34 of neighbouring rows.

In the illustrated embodiments at least one lateral edge of the upper section 36 of the internal panel 13 is abutting against an upper edge of the at least one lateral section 37, 38 of the first side wall 2. Hence, the at least one lateral edge of the upper edge section 36 and the upper edge of the at least one lateral section 37, 38 form abutting edges. A juncture connecting the upper section 36 and the at least one lateral section 37, 38 along at least a part of their abutting edges may comprise a spot-like shape. The juncture may also comprise an elongated shape, bended or straight shape. Typically, the upper section 36 of the internal panel 13 and at least a lateral section 37, 38 of the side wall 2 are bonded along a seam 31, 32 extending from the opening 35 towards an edge 6, 17, 18 of the first side wall 2. Alternatively, the seam may extend towards the corner formed between the upper edge 6 and one of the side edges 17, 18.

The juncture between the upper section 36 and the at least one lateral section 37, 38 may also comprise a point-like shape or structure. For the juncture of lateral and upper section at least one bond point is required. There may also be provided a plurality of various bond point arranged along the seam 31, 32. The seam 31, 32 may extend over the entire length of the abutting edges. Alternatively, the seam 31, 32 may also extend only across a section of the length of the abutting edges. The seam 31, 32 or the juncture between the lateral sections 37, 38 and upper section 36 of the side wall 2 typically extends in direct vicinity of the opening 35 to be created in the side wall, e.g. the seam or juncture extends only along up to 25%, or up to 40% of the length of the abutting edges (starting from the opening). Alternatively, the seam or juncture may extend along the whole length of the abutting edges.

In typical embodiments, the seam 31, 32 may extend at an angle of between 40 to 50 degrees, or from 42° to 48°, or 45°, upper with respect to the upper edge 6 of the side wall 2. In these embodiments, the upper section 36 and the at least one lateral section(s) 37, 38 form a mitered joint. The seam 31, 32 then extends from a location on the edge of the opening 35 defined by a crossing point of the lower edge 21 of the upper section 36 and the side edge 25 of a lateral section 37 towards an upper corner of the package 1. At this upper corner the side edge 17, 18 and the upper edge 6 of the side wall 2 merge into each other, respectively.

By means of connecting or bonding lateral sections 37, 38 and upper section 36 of the side wall 2 as a mitered joint, the frame formed by the lateral section(s) 37, 38 and the upper section 36 may provide an improved stability and may withstand a pressure or an outwardly directed force emanating from the articles 33, 34 being tightly packed and compressed in the inside of the package 1. In particular, when after creation of the opening 35 various diapers 33, 34 tend to bulge out of the opening 35, the way the upper and lateral section(s) 36, 37, 38 are mutually bonded or connected may provide an enhanced stability and resistivity against forces and pressures exerting mechanical strain and stress on the package 1.

The side wall 2 has at least a first line of weakness 15, 16 separating the tear-off portion 10 and the at least one lateral section 37, 38 of the side wall 2. Typically, the line of weakness 15, 16 begins at an inner edge or at an inner location (e.g. a corner, if the frame takes a rectangular shape) of the frame being formed by the at least first lateral section(s) 37, 38 and the upper section 36 of the internal panel 13 of the side wall 2. The line of weakness 15, 16 may further extend towards a lower edge 7 of the first side wall 2. Typically, the line of weakness 15, 16 does not extend all the way down to the lower edge 7 but ends at a distance from the lower side edge 7. In such an embodiment, the retaining frame formed after opening the package 1 entirely surrounds the opening 35, such that each lateral, upper or lower edge of the opening 35 has a certain distance to an associated side edge 6, 7, 17, 18 of the side wall 2.

The opening defined by the lines of weakness 15, 16, 20 may be quadratic, rectangular, oval or round in shape. Alternatively, the opening may take any other form. Also, the opening 35 may vary in width. Typically, in an upper portion adjacent or close to the upper section 36 of the side wall 2, the opening 35 may be narrower than in a lower portion of the opening 35. Consequently, the lines of weakness 15, 16 specifying the shape of the opening 35 may diverge with respect to each other as the extend from an upper portion to a lower portion of the side wall 2. The shape of the lines of weakness 15, 16 may have the form of a straight line or may comprise bended or curved portions, featuring a concave or convex shape.

In the illustrated embodiment of FIG. 1, the lines of weakness 15, 16 have an upper portion 27 featuring a rather straight shape and being arranged substantially parallel to the elongation of the side edge 17, 18 of the side wall 2. The lines of weakness 15, 16 further have a lower portion comprising a bended or curved shape. In these lower portions 28, the lines of weakness 15, 16 not only extend downward towards the lower edge 7 but also extend outwardly towards respective side edges 17, 18 of the side wall 2.

Hence, along upper sections of the lines of weakness 15, 16, the opening 35 is somewhat narrower compared to lower sections of the lines of weakness being closer to the lower edge 7 of the side wall 2.

Those parts of the articles 33, 34 lying adjacent the wider and lower section of the opening 35 may more easily bulge out through the opening 35. Thus, it is easier for a consumer to grip the article (e.g. a folded diaper 33, 34) upon opening the package 1. The article (e.g. the folded diaper 33, 34) lying closest to the opening 35 can be easily taken by the consumer in the area of the article (e.g. the folded diaper 33, 34), which has bulged out of the opening 35. Alternatively, the first article (e.g. the first folded diaper 33, 34) and one or more of the following articles (e.g. folded diapers) may be taken out together, provided that the lateral width of the lower portion of the opening 35 allows more than one article (e.g. folded diaper) of the row to bulge out of the opening.

Also in embodiments wherein the package 1 comprises only one row of articles such as diapers 33, 34, the width of the opening 35 at an upper portion may be smaller than a width at a lower portion of the opening 35. If the package 1 comprises two rows of diapers 33, 34, and the lines of weakness 15, 16 each comprise upper and lower section 27, 28, the distance between lower sections of the lines of weakness 15, 16 may be smaller than the width of both rows of diapers 33, 34 taken together. However, the distance between lower, eventually bended sections 28 of the lines of weakness 15, 16 may be larger than the width of a major surface of a diaper 33, 34.

Further, the line of weakness or the various lines of weakness 15, 16, 20 may extend into the seam 31, 32 connecting or bonding the upper section 36 of the internal panel 13 with the lateral sections 37, 38 of the sidewall. Such an arrangement is beneficial because the lines of weakness 15, 16, 20 then inherently provide predetermined breaking lines of the side wall 2 adjacent to the seam 31, 32, inherently providing a reinforced structure due to an at least partial doubling of material. Practically, in order to form the seam 31, 32 lateral and upper portions of the upper section 36 and the lateral sections 37, 38 substantially overlap.

Further, not only one but at least two lines of weakness 15, 16, namely the first and/or second line of weakness 15, 16 and the third line of weakness 20 may both extend into a respective seam 31, 32. Typically, the innermost portion of the seam 31, 32 lying adjacent an upper left or an upper right location (e.g. corner) of the opening 35 overlaps or coincides with a junction of the first line of weakness 15 and the third line of weakness 20; or with a crossing or junction of the second line of weakness 16 and the third line of weakness 20.

The various lines of weakness 15, 16, 20 may comprise a structural weakening being adapted to disassemble or to disrupt upon exertion of a tearing-off force applied via the tearing means 11. Further, the lines of weakness 15, 16, 20 may comprise a perforation or a zigzag-structure.

The seams 31, 32 connecting the upper section 36 of the internal panel 13 with lateral sections 37, 38 of the side wall 2 extend at least into or over the first and second lines of weakness 15, 16. Moreover, the seam 31, 32 may further extend to the side seam 19 of the first side wall 2. In typical embodiments, this side seam 19 is arranged substantially equidistant from the lateral side edges 17, 18 of the first side wall 2. If the seam 31, 32 begins at an upper side corner of the first side wall 2, it will extend onto or across at least one line of weakness 15, 16, 20, in the closed configuration of the package 1. In such embodiments where the seam 31, 32 extends from an upper lateral corner of the side wall 2 to the side seam 19, which in turn typically extends across the entire side wall 2 from the lower edge 7 to the upper edge 6, the tearing means 11 becomes structurally reinforced, thus helping to ensure, that the tear-off portion 10 or the tearing means 11 itself does not disassemble and break during an opening of the package 1. Hence, even in circumstances, where the tongue-like appendix of the tearing means 11 is gripped near a lateral side edge 29, 30, the portion of the seam 40, 41 extending into the gusset 12 should provide a sufficient mechanical stability such that during a tear-off procedure the tearing means 11 remains in its entirety as e.g. illustrated in FIG. 2.

As further depicted by the dashed lines 40 and 41 in FIG. 2, the portion of the seam 31, 32 extending into the tearing means 11 is typically co-aligned with fold lines, along which an inner layer 63, 64 and an outer layer 61, 62 of the external panel 14 forming the tearing means 1 are folded in order to form the triangle-shaped pocket or gusset 12. Hence, the seam and its consecutive and co-aligned portions 31, 41 as well as 32, 40 may be adapted to bond the upper section 36 of the internal panel 13 with lateral section 17, 18 of the side wall 2 as well as to bond an inner layer 63, 64 and an outer layer 61, 62 of the two-plied external panel 14.

The fold lines or seam portions 40, 41 typically encompass the first gusset 12 of the first side wall 2 towards its lower edge 7, as can be seen in FIG. 1.

The external panel 14 comprises a tongue-like appendix which can be gripped to tear open the package. The external panel may further comprise a smaller lateral width compared to the distance between opposing side edges 17, 18 of the first side wall 2. Consequently, the external panel 14 has a first and a second side edge 29, 30 confining the external panel in lateral direction. If a part of the external panel 14 has been cut away, at least a lateral portion of the upper section 36 of the internal panel 13 is not overlaid by the external panel 14 but directly contributes to the outer appearance of the side wall 2. The typically two-plied external panel 14 comprises a fold line connecting the two layers of the external panel 14. This fold line is adjacent to the upper edge 6 of the side wall 2, when the package 1 is closed. Along the at least one side edge 29, 30, the inner and outer layers of the external panel 14 may be mutually unconnected. Alternatively, the external panel 14 and its inner and outer layers may be bonded or connected along the side edge 29, 30.

In an alternative embodiment, the external panel 14 may be co-aligned with the internal panel 13 but may further comprise a line of weakness transforming into a slit upon opening of the package, wherein the slit coincides with side edge 29, 30 of the external panel 14 forming the tear-off portion 10. Instead of such an additional line of weakness, the external panel may also be directly provided with a slit, at least partially separating the external panel into various portions.

The slit may have any suitable shape and geometry and separates the tearing means 11 from a residual portion of external panel 14 which does not contribute to the tear-off portion 10. The slit may extend in vertical direction and/or may be an elongation of the first and/or second line of weakness 15, 16. It may also extend at an angle with respect to the lines of weakness or with respect to the upper edge 6 of the package 1. For instance, the slit may extend along the seam 30, 31 at an angle of between 40° to 50°, 42° to 48° or at an angle of 45°. The slit or the line of weakness may extend from an upper edge 6 of the side wall 2 into the seam 31, 32. The residual portion of the external panel 14 being disposed outside the tongue-like appendix may be connected or bonded to the internal panel by means of an adhesive or by means of a bonding or welding procedure.

In typical embodiments, as exemplary illustrated in FIGS. 1 and 2, the at least first side edge 29, 30 of the external panel 14 extends to the seam 31, 32. Additionally, the at least first side edge 29, 30 may be aligned parallel to the at least first line of weakness 15, 16. From another point of view, the seam 31, 32 traverses or intersects the alignment of side edges 29, 30 and the line of weakness 15, 16 directly at a juncture connecting side edges 29, 30 and the consecutive line of weakness 15, 16.

In embodiments, where the side edges 29, 30 of the external panel 14 are separately seamed in order to bond the two layers forming the two-plied external panel 14, the respective layers of the external panel 14 may no longer have to be seamed along the fold lines 40, 41. Vice versa, if the outer and inner layers of the external panel 14 are bonded along their lower fold lines 40, 41 there may be no need to bond or to connect the two layers along the side edges 29, 30 of the external panel. Typically, at least one seam is introduced into the external panel 14, either along the fold lines 40, 41 or along the side edges 30, 29. Otherwise, the content of the package 1 could be accessible from outside even before the tearing means 11 is torn away.

The tearing means 11 is typically comprised only by one of the opposing side walls 2, 3 of the package 1. As for example illustrated in FIG. 3, the second side wall 3 differs from the design of the opposing first side wall 2 in that it does not comprise tearing means 11 in order to create an opening 35 in the side wall 3. In contrast, the side wall 3 may comprise a gripping means 45 adapted to provide an easy and intuitive transporting and lifting of the package 1. The opposing side walls 2, 3 of the package 1 provide different and spatially separated means, either for transporting and gripping or for opening of the package 1. By arranging gripping means 45 and tearing means 11 at different and opposing side walls 2, 3 of a package 1, an inadvertent opening of the package 1 upon lifting, e.g. from a shelf can be effectively prevented. In detail, the gripping means 45 provided at the side wall 3 are not adapted to create an opening 35 in the package 1 whereas the tearing means 11 provided at the opposing side wall 2 are rather unsuitable to grip the package, e.g. for transportation or lifting purpose.

The second side wall 3 of the package 1 also comprises at least a second gusset 42 comprising an internal panel 43 and an external panel 44 together forming a second pocket. The second side wall 3 further comprises a gripping means 45 being formed in or through the external panel 44. The gripping means 45 may be configured as an aperture and/or may be configured as a slit 46, whereby the gripping means may take various shapes as long as it ensured, that one or more fingers of a person's hand fit through the gripping means 45 to allow lifting and transporting the package 1. The gripping means 45 may be formed as an aperture by removing a portion of the external panel 44. Alternatively, the gripping means 45 may be formed as a slit in or through the external panel 14, i.e. without removing any material when forming the gripping means 45.

Moreover, the gripping means 45 can be formed as a weakened area, such as an area being at least partially circumvented by a structural weakening 50, such as a perforation. In such an embodiment, the perforation or structural weakening may be transformed into a slit when a user, intending to lift the package 1, is gripping through the pocket or gusset 42 with his fingers, thereby at least partially breaking the perforation. In these embodiments, the one or more fingers of a person of course only have to fit through the gripping means 45 after the perforation has been broken. As illustrated in FIG. 3, the gripping means comprises a substantially horizontally aligned slit adjacent a lower edge 51 of an upper portion of the external panel 44, which forms a strap extending across the entire width of the side wall 3 adjacent to the upper edge 8 of the side wall 3.

Figure 9:
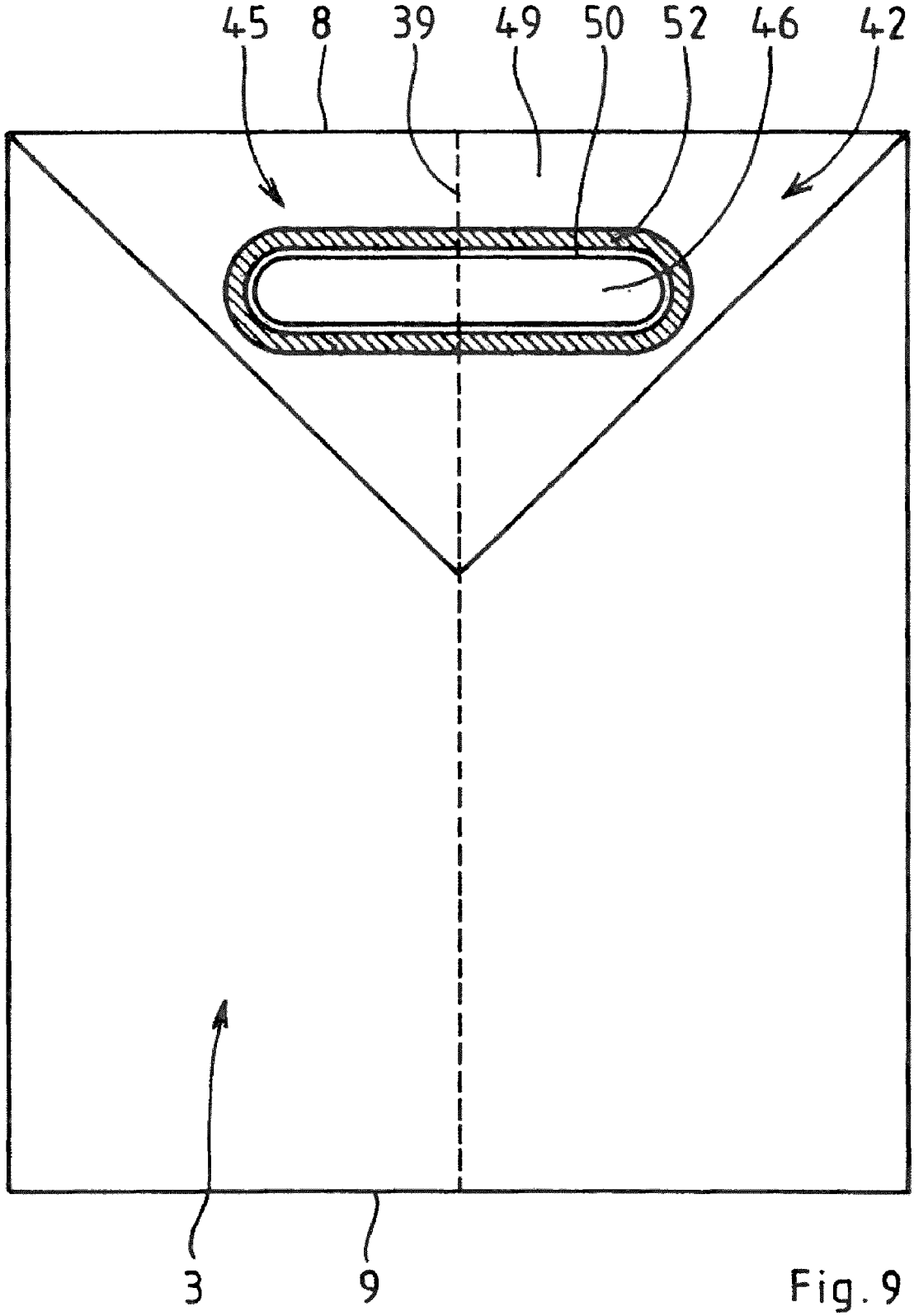
FIG. 9 in a front view, another embodiment of the second side wall of the package comprising a reinforced aperture as gripping means.

In an alternative embodiment, as e.g. depicted in FIG. 9, the gripping means 45 comprises a substantially oval- or rectangular-like shape, wherein an inner portion 46 is entirely circumvented by a structural weakening 50 being in turn encompassed by a structure of reinforcement 52. The strap 49 of the external panel 44 is that part of the second side wall 3 extending in height from an upper edge of the aperture or the slit 46 of the gripping means 45 to the upper edge 8 of the external panel 44. The strap 49 is adapted to be grasped manually from below in order to lift the package 1.

Furthermore, the strap 49 may also be grasped from above to lift the package 1. Hence, the user may enter with his finger(s) into the pocket or gusset 42 from the upper edge 8 between the internal panel 43 and the external panel 44. As the finger tips proceed they may reach through or they may penetrate the external panel 44 in the region of the gripping means 45 being designed as an aperture or being alternatively designed as a structural weakening to be broken upon a first gripping.

In any gripping manner, the hand of the user is clasped around the strap 49 allowing for an easy and intuitive raising and transporting of the package 1. The strap 49 takes up the force manually applied and added directly above the gripping means 45. When a package is lifted up, the strap 49 provides sufficient resistance to transfer the force to the rest of the side wall 3 and to the package 1 without tearing or disassembling the strap 49 or the respective side wall 3. Thus, unintentional opening of the package 1 can be effectively prevented.

Since the strap 49 and its associated gripping means 45 are separately designed and arranged with respect to the tearing means 11, the strap 49 and its gripping function is nearly not affected by an opening of the package 1 at the opposing side wall 2. Therefore, even after the package 1 has been opened, the strap 49 can still be used to assist in lifting or transporting the package 1.

The height of the strap 49 extending from the gripping means 45 to the upper edge 47 of the external panel 44 and hence to the upper edge 8 of the side wall 3 may range from 10 millimeters to 50 millimeters. These dimensions allow for convenient carrying and ensure that the strap 49 does not tear apart upon lifting of the package 1. The gripping means 45 may have an upper edge corresponding to the lower edge 51 of the strap 49.

Figure 8:
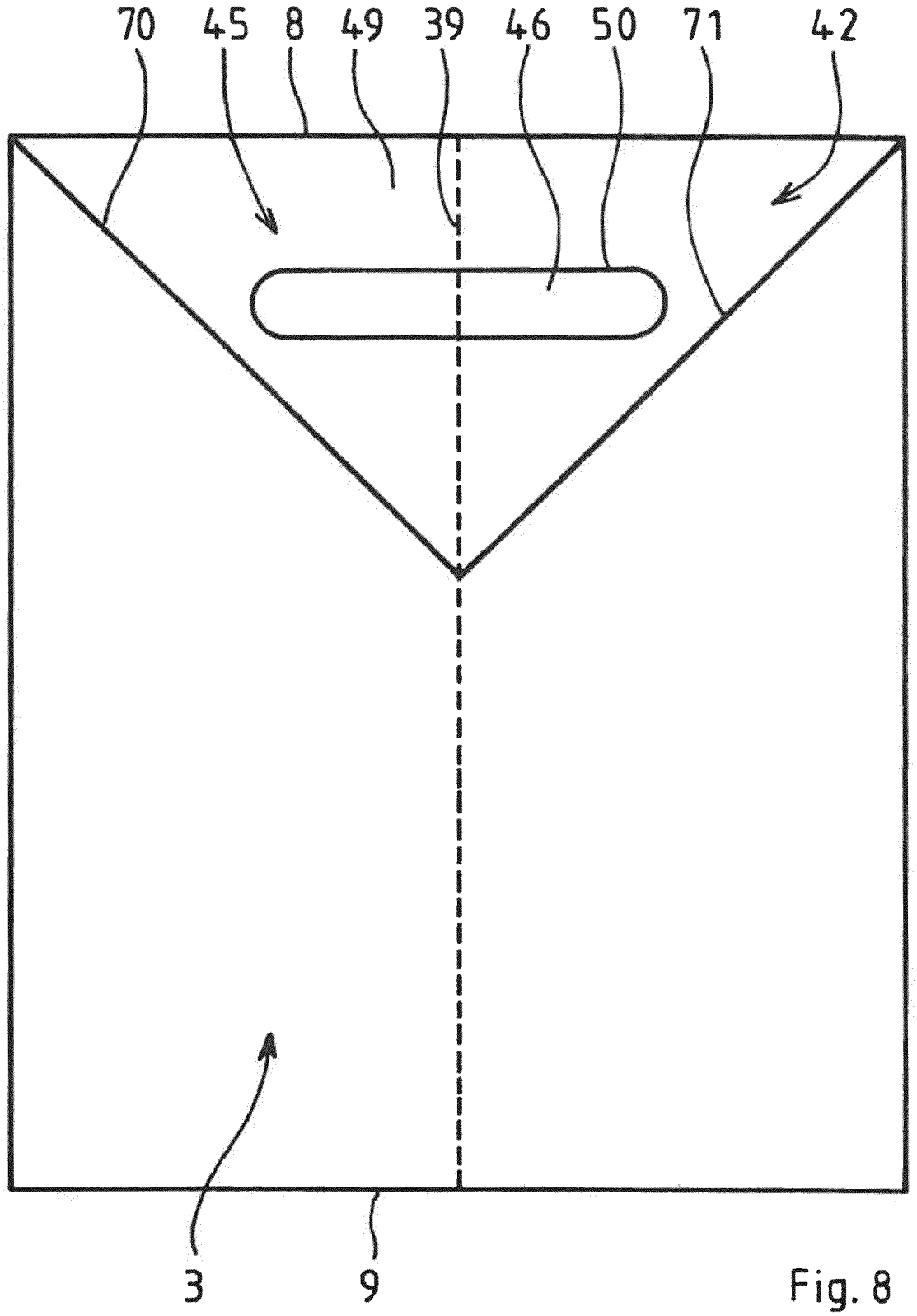
FIG. 8 in a front view, a schematic and simplified illustration of the second side wall comprising gripping means.

As further illustrated in FIGS. 3 and 8, the gripping means 45 is formed through or in the external panel 44 of the second gusset 42. Hence, a portion of the pocket, which is covered by the gusset 42, extends from a lower edge of the gripping means 45 towards the lower edge 9 of the side wall 3. If the pocket takes the form of a downward pointing triangle, a portion of the pocket extending from a lower edge of the gripping means 45 downwards will also take the form of a, however smaller, triangle. This smaller triangle can be further used to slit at least a part of a user's finger into, providing a universal way of gripping and lifting the package 1.

The way, the gusset 42 is configured in the second side wall 3, is well-known in the art. The external panel 44 comprises two layers, an inner layer and an outer layer. The gusset 42 has a triangle-shaped geometry and it is confined by two fold lines 70, 71 and by an upper edge 47 of the external panel 44 as illustrated by way of example in FIG. 3. In order to reinforce the gripping means 45, the inner and the outer layers of the external panel 44 may be reinforced adjacent lateral and upper as well as lower edges of the gripping means 45. The structure of reinforcement 52 as e.g. depicted in FIG. 9 may be introduced by bonding, joining or connecting the inner and outer layer of the external panel 44 along a predetermined structure. The gripping means 45 as illustrated in FIG. 9 comprises an aperture 46 being executed as a cut away of material over a region of approximately rectangular shape comprising oval or curved edges. The aperture 46 is circumvented or surrounded by a closed structure of reinforcement 52. However, the reinforcement structure 52 is not confined to such embodiments, wherein the gripping means 45 is designed as an aperture 46. Such reinforced gripping means can also be facilitated in any other way or embodiment as described above.

It may be desirable to reinforce the inner and outer layers of the external panel 44 only adjacent the lower edge 51 of the strap 49. In particular, it may be desirable to reinforce the layers in the respective lower area of the strap 49 being adjacent the upper edge of the gripping means 45, since upon lifting up the package 1, the strap 49 will typically experience the major strain compared to the gripping means 45 arranged below.

To reinforce the external panel 44, e.g. in the vicinity of the gripping means 45, the inner and outer layer of the external panel 44 may be bonded to each other adjacent the entire upper and/or lower edge of the gripping means 45. Alternatively, the inner and outer layer may be bonded to each other at least adjacent the upper or lower edge of the gripping means 45.

The bonding of the inner and outer layers can be achieved, e.g. by adhesive bonding, pressure bonding as well as by means of thermal bonding or ultrasonic bonding, especially, if the flexible package is made of thermoplastic material. Other suitable bonding means known in the art are also within the scope of this invention. The bonding of the inner and outer layers can be done intermittently adjacent the edges of the gripping means 45 or can be executed as a continuous bonding line extending adjacent the upper and/or lower edge of the gripping means 45.

There are several alternative ways of providing the package with gripping means. They do not necessarily have to be disposed at the side wall 3 opposite to the side wall 2 comprising the tearing means 11. Alternatively, they may comprise a lug or a strap-handle being attached to the front or back wall of the package. Also, the gripping means may be attached to the top wall 4. These alternative gripping means may further be detachably fixed to the package 1 and may be released for gripping purpose by a user interaction.

Figure 4:
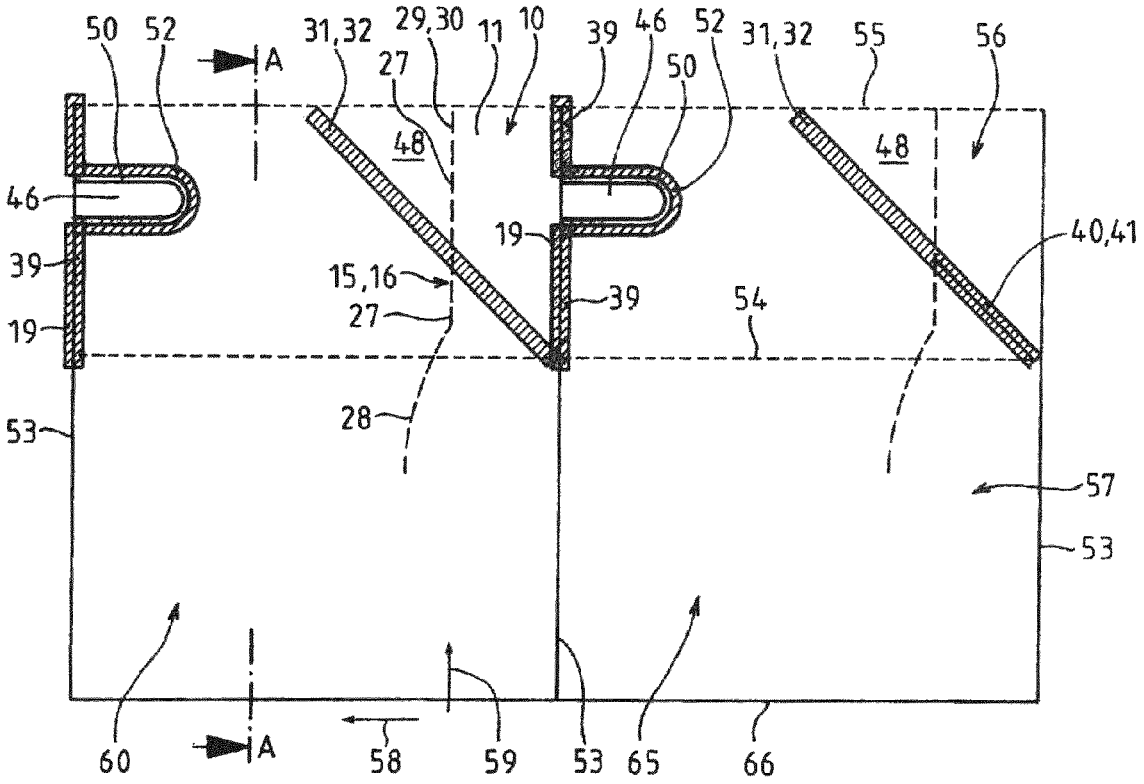
FIG. 4 in a front view, two packages during manufacture from an endless sheet.
Figure 5:
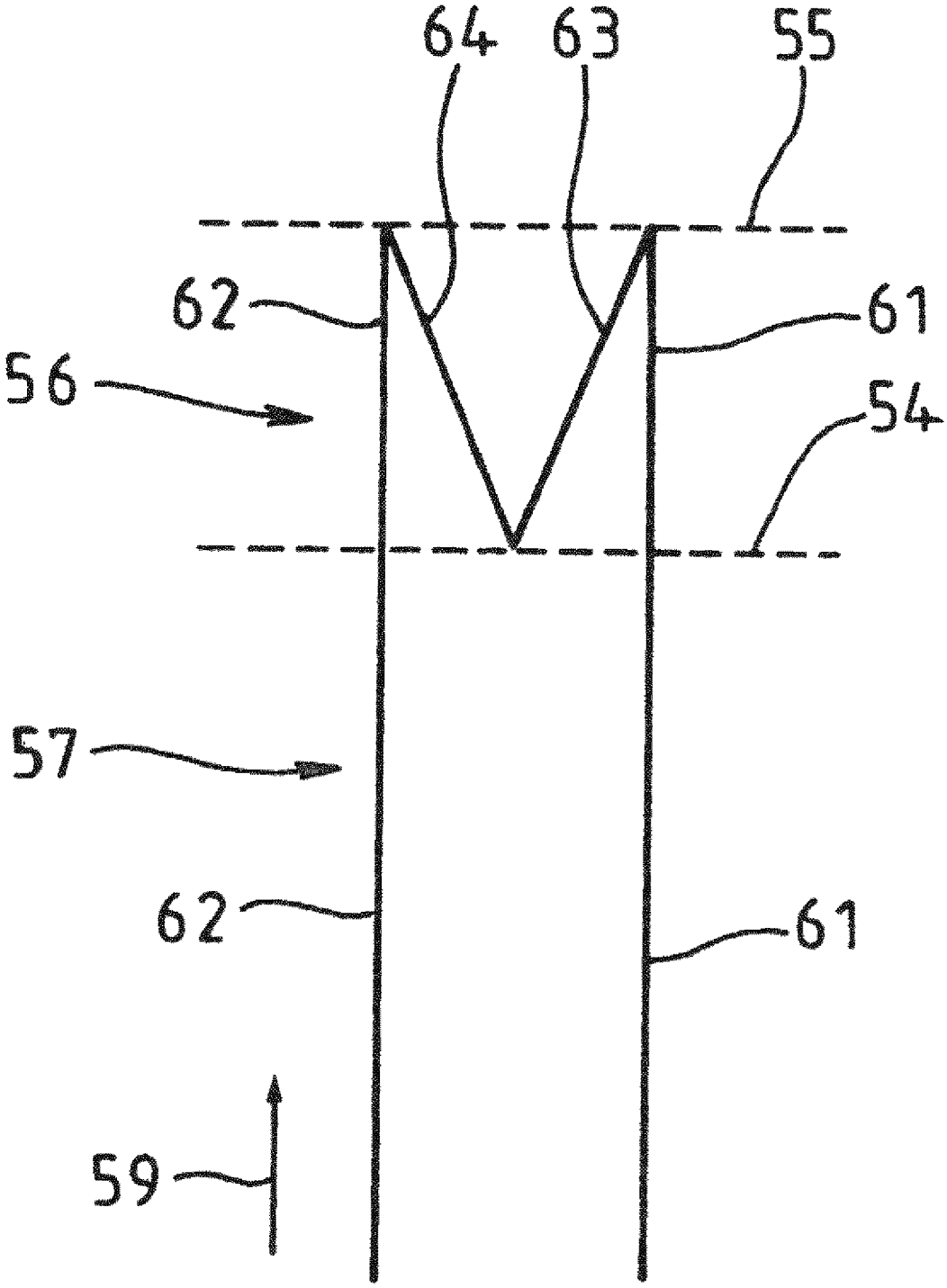
FIG. 5 a schematic illustration of various layers of the endless sheet according to FIG. 4 as seen along cross section A-A.
Figure 6:
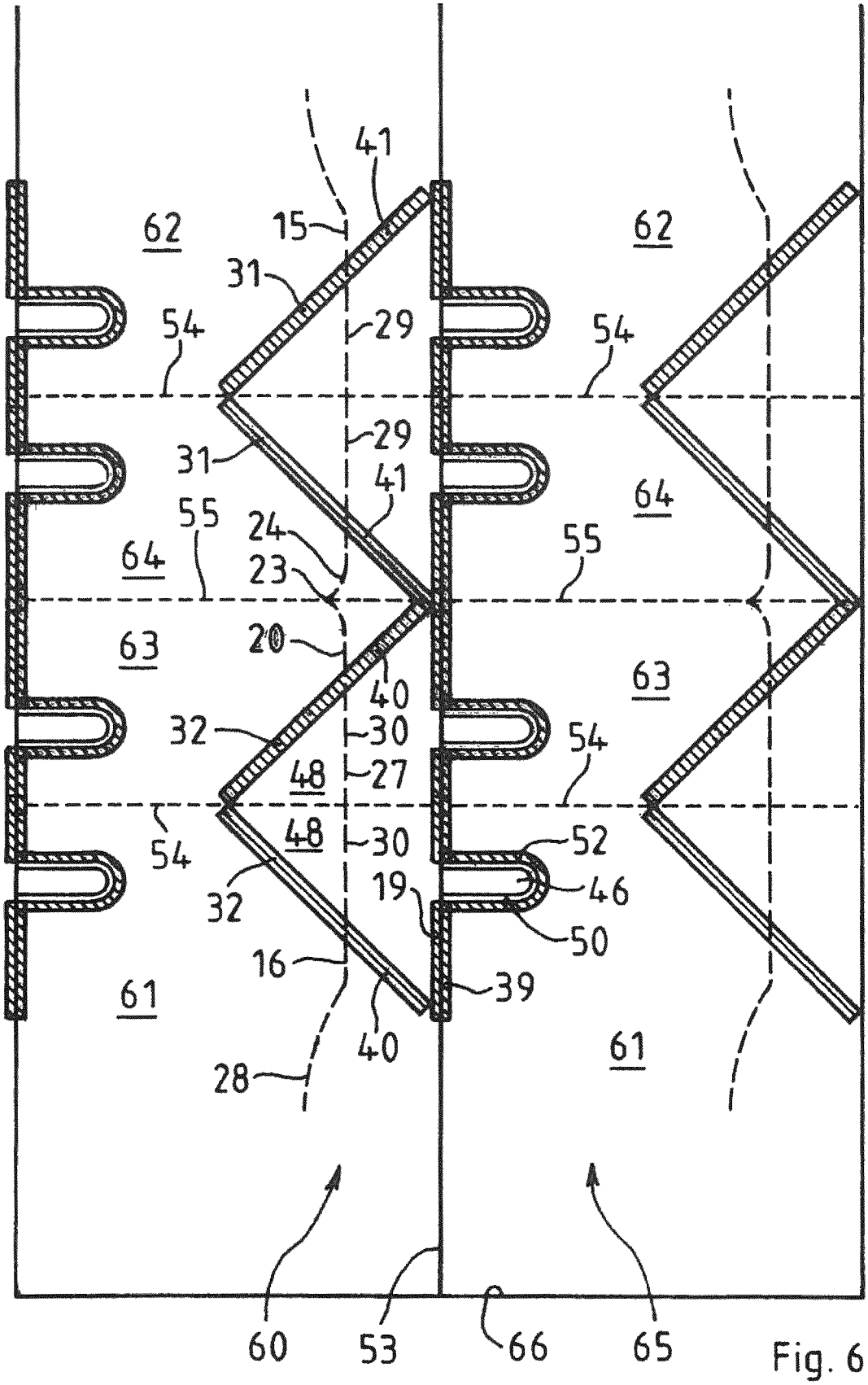
FIG. 6 a schematic illustration of the two packages according to FIG. 4 in an unfolded configuration.

FIGS. 4 through 6, schematically illustrate a possible way of manufacturing the flexible package 1. The manufacture of the package 1 may start from an endless sheet travelling in machine direction 58. The sheet as illustrated in FIG. 4 and shown in cross section along A-A in FIG. 5 is folded multiple times with respect to fold lines 54 and 55 in such a way, that the folded sheet, in machine direction 58, comprises a twofold portion 57 and a fourfold portion 56. The fold lines 54 and 55 extend in machine direction 58 along machine direction 58. In cross machine direction 59, the sheet has a lateral or marginal edge 55 and 66. The upper marginal edge 55 of the fourfold portion 56 is coextensive and therefore identical to the fold line 55.

The fold line 55 therefore forms an upper marginal or lateral edge of the folded sheet, whereas the other fold line 54 separates the twofold portion 57 and the fourfold portion 56. The folded sheet further has a lower edge 66, which is at the twofold portion 57. The lower edge 66 of the twofold portion 57 later on forms at least a part of the bottom wall of the package 1, whereas the opposing edge 55 of the fourfold portion 56 forms a portion of the top wall 4 of the package 1.

The fourfold portion 56 of the M-shaped folded sheet comprises two outer layers 61, 62 forming at the same time the two layers 61, 62 of the adjacent twofold portion 57. Sandwiched between the two outer layers 61, 62, the fourfold portion 56 further comprises two inner layers 63, 64 disposed adjacently in an overlapping manner. The two inner layers 63, 64 as well as the two outer layers 61, 62 are portions of the folded endless sheet. The inner layers 63 and 64 mutually merge at the fold line 54 and each inner layer 63, 64 merges into the adjacent outer layer 61, 62 at the fold line 55.

After having folded the endless sheet to an M-shaped fold comprising a twofold portion 57 and an adjacent fourfold portion 56 in cross machine direction 59, at least one line of weakness 15, 16 is introduced in each layer 61, 62, 63, 64 of the fourfold portion 56 such that the lines of weakness are preferably introduced in the same location of the overlaying layers 61, 62, 63, 64. The line of weakness forms the tearing means 11 for providing an opening 35 in the at least first side wall 2. The line of weakness 15, 16 may be implemented as a perforation, a zigzag-structure or as a partial or complete cut or slit in or through the material of the fourfold portion 56. Furthermore, at least one outer layer 61,62 of the fourfold portion 56 is partially bonded or connected with an adjacent inner layer 63, 64 of the fourfold portion for generating a frame adapted to retain the articles 33 34 inside a filled package 1.

In general, it is sufficient to bond the at least one outer layer 61, 62 and the adjacent inner layer 63, 64 of the fourfold portion 56 in a singular point or region typically in direct vicinity of the line of weakness 15, 16. In order to generate a frame comprising an upper section 36 and two lateral sections 37, 38 it is suggested to at least partially bond the outer layer 61 with the adjacent inner layer 63 and to bond the outer layer 62 with the adjacent inner layer 64 in an overlapping manner, whereby the adjacent inner layers 63 and 64 remain separated from each other and remain practically unaffected by the bonding with the adjacent outer layers 61, 62.

Bonding of adjacent outer and inner layers 61, 62, 63, 64 as well as introducing at least one line of weakness 15, 16 can either be executed simultaneously or sequentially. It is further possible to at least partially bond adjacent inner and outer layers 61, 62, 63, 64 before the at least one line of weakness 15, 16 is introduced into at least the fourfold portion 56. Alternatively, it is also possible to bond the adjacent layers 61, 62, 63, 64 after the line of weakness 15, 16 has been introduced in the above described way.

After introduction of the at least one line of weakness 15, 16 and after a partial bonding of adjacent inner and outer layers 63, 64, 61, 62, all layers 61, 62, 63, 64 of the endless sheet are sealed and cut along a side seam 19, 39, 53 extending substantially in cross machine direction 59. The side seam bonds and connects all layers of the respective twofold and fourfold portion 57, 56 and further splits first and second packages 60, 65 being consecutively arranged in the endless sheet. The sealing and cutting may be performed simultaneously by means of a combined seaming and cutting stage. By means of the sealing, all layers 61, 62, 63, 64 of the endless sheet become inherently provided with a side seam 19, 39 connecting in one step the two layers 61, 62 of the twofold portion 57 as well as all four layers 61, 62, 63, 64 of the fourfold portion 56 Forming and generating of the side seam 19, 39 as well as cutting or disassembling of adjacent and consecutive packages 60, 65 may be executed in a single step by means of the a convenient seaming and cutting apparatus.

Figure 7:
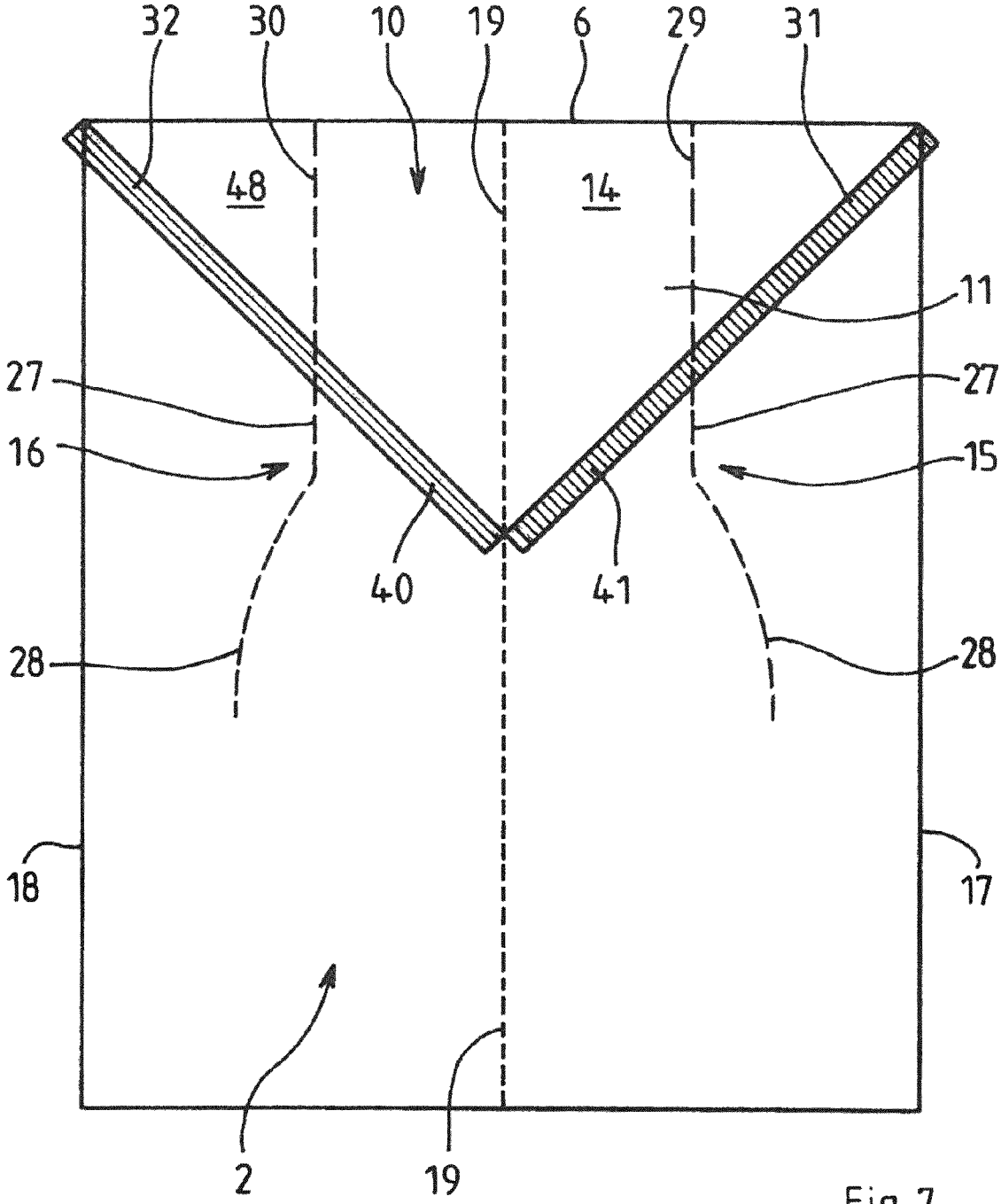
FIG. 7 in a front view, a schematic and simplified illustration of the first side wall comprising opening means.

By way of comparing the illustrations of FIGS. 4, 5 as well as FIGS. 7 and 8, the sealing of the various layers 61, 62, 63, 64 and their final arrangement in the package 1 becomes apparent. The side seam 53 and the cutting line separating adjacent and consecutive packages 60, 65 also form the first side seam 19 of the first side wall 2 of a package 60 and the second side seam 39 of a second side wall 3 of a consecutive package 65. Both side seams 19 and 39 connect outer layers 61 and 62 and form left and right lateral portions of side walls 2, 3 of the package 1.

Furthermore, the side seams 19, 39 are also bonding the two inner layers 63, 64 in cross-machine direction. With respect to FIGS. 1 and 3, these portions of the inner layers 63, 64 in close vicinity to the side seam 19, 39 later on form an inner layer of the external panel 14, 44, whereas respective portions of the outer layers 61, 62 form the outer layer of the external panel 14, 44. The internal panel 13 and its upper section 36 of the first side wall 2 is entirely formed by the inner layers 63, 64.

Further, it is suggested to bond the outer layers 61, 62 with adjacent inner layers 63, 64 along a seam 31, 32 extending in the fourfold portion 56 of the endless sheet. The seam 31, 32 should be confined to the fourfold portion 56. Typically, this seam 31, 32 only bonds the outer layer 61 with its adjacent inner layer 63 and the outer layer 62 with its adjacent inner layer 64. Bonding of adjacent outer and inner layers 61, 62, 63, 64 is executed in such a way, that the inner layers 63, 64 remain separated from each other all the way along the seam 31, 32. Since the two seams 31, 32 are introduced in the fourfold portion 56 of the endless sheet in an overlapping manner, after introducing the side seam 19, 39 and cutting consecutive packages 60, 66 along the line 53, the side wall 2, as illustrated in FIG. 7, has a substantially symmetric configuration with respect to the side seam 19.

Further, each seam 31, 32 intersects or extends into lines of weakness 15, 16, thereby specifying the width of the upper edge of the opening 35 to be generated by the tearing means 11, respectively.

With respect to FIG. 7, the lines of weakness 15, 16 may extend up to the upper edge 6 of the side wall 2. The lines of weakness 15, 16 in particular their upper straight section 27 at least extend into the seam 31, 32. The external panel 14 as it extends above the crossing points of the seam 31, 32 and the lines of weakness 15, 16 may comprise lateral edges 29, 30 confining the lateral width of the tongue-like appendix of the external panel 14. Furthermore, the external panel may also be cut from an upper edge 6 of the side wall 2 adjacent the seam 31, 32 down to the crossing point of the seam 31, 32 and the lines of weakness 15, 16 in order to remove a triangle-shaped section 48 of the external panel 14. By removing a triangle-shaped portion 48 being confined by the lateral edges 29, 30, the upper edge 6 of the side wall 2 and the seams 31, 3, the tongue- or flap-like appendix of the external panel 14 providing an intuitive and universal tearing means 11 can be provided.

Alternative to the removal of the triangle-shaped portion 48, the external panel 14 may comprise a slit or an additional line of weakness providing a separation of the flap-like appendix from the external panel 14.

The side seams 19, 39 extending substantially in cross machine direction 59 as well as the seams 31, 32 may be introduced into the various layers 61, 62, 63, 64 of the endless sheet separately or simultaneously. Furthermore, with respect to FIGS. 4 and 6, adjacent to the side seam 39 a structure of reinforcement 52 extending into the side seam 39 may also be introduced into pairs of overlapping outer and inner layers 61, 63 as well as 62, 64. Additionally, also a structural weakening 50, which may typically designed as a perforation or a slit may be introduced adjacent the structure of reinforcement 52. The structure of reinforcement 52 may be introduced simultaneous with the structure of weakening 50. However, it may also be advantageous to introduce the structure of reinforcement 52 before the structural weakening 50 is applied to the endless sheet.

The structure of reinforcement 52 may take any shape. It can be oval, circular, or may have a slit like geometry. Further, the structure of reinforcement 52 should be disposed or arranged at a distance from the edge 55 of the fourfold portion 56. The distance between the structural weakening 50 and the lateral edge 55 defines the height of strap 49 in the final package. Hence, the edge 55 corresponds to the tipper edge 6, 8 of the side walls 2, 3.

The outer layer 62 can be joined or bonded with its adjacent inner layer 64 by any kind of suitable joining or bonding means, such like ultrasonic bonding, thermal bonding or pressure bonding. Accordingly, the outer layer 61 is joined or bonded with the adjacent inner layer 63. However, the two inner layers 63, 64 are not joined or bonded to each other when introducing a structure of reinforcement. For instance, when applying ultrasonic-, thermal- or pressure bonding, it has to be ascertained, that the two inner layers 63, 64 remain separated from each other.

For a selective and systematic separation of the inner layers 63, 64, it is suggested that a separating means or a separating agent may be inserted or disposed between the inner layers before the outer layer 61 is bonded or joined with the adjacent inner layer 63 and when the outer layer 62 is bonded or joined with the inner layer 64 along the structure of reinforcement 52. Especially when thermal or ultrasonic bonding is applied for introducing the structure of reinforcement 52, it is advantageous to make use of heat resistant separating means, such as a heat resistant sheet which may optionally be the coated with a non-stick medium or with a non-stick coating.

In the illustrated embodiments, the structure of reinforcement 52 is of closed shape and the structural weakening 50 is adjacently arranged inside the structure of reinforcement 52. Typically, the gripping means 12 and the aperture 37 or the slit are surrounded by the structure of reinforcement 52. However, the structure of reinforcement 52 does not have to completely encompass the structural weakening 50.

The side seams 19, 39 extending in cross machine direction 59 comprise a certain width in machine direction 58. A combined width of both side seams 19, 39 is approximately between 3 and 10 millimeters allowing, that positioning of the side seams 19, 39 as well as positioning of the seam and cut line 53 does no longer need to be absolute precise but may vary within certain limits. Even though when the side seam is unequally divided into side seams 19, 53 of consecutive packages 60, 65 along a seam and cut line 53, a sufficient seaming and sealing of the respective side walls 2, 3 of the packages 60, 65 can still be achieved. In typical embodiments, the side seams 19, 39 disposed in the fourfold portion 56 are wider in machine direction than the seam 53 being introduced in the twofold portion 57 of the endless sheet. For instance, the combined width of the seams 19, 39 is twice as large as the width of the seam 53. The width of each seam 19, 39 may vary between 3 to 10 mm. Before the side seams 19, 39 are introduced into the material, thereby joining and bonding the various layers 61, 62, 63, 64 and disassembling to adjacent packages 60, 65, the lines of weakness 15, 16 may be introduced at least into the fourfold portion 56. The lines of weakness 15, 16, may also extend into the twofold portion 57, respectively. The lines of weakness 15, 16 are typically introduced simultaneously in all layers 61, 62, 63, 64 of the fourfold portion 56 and the twofold portion 57. Consequently, the lines of weakness 15, 16 substantially take the same overlapping shape in all these layers 61, 62, 63, 64. The lines of weakness 15, 16 with their lower or bended portion 28 traverse the fold line 54 separating the twofold portion 57 from the fourfold portion 56 of the endless sheet. After seaming and disassembling adjacently manufactured packages 60, 65 along the cut and seam line 53 and after filling the packages 60, 65 with articles 33, 34 the first 15 and second 16 lines of weakness become apparent, as depicted in FIGS. 1 and 7, both extending across the seam 31, 32.

FIG. 6 schematically illustrates the two packages 60, 66 of FIG. 4 when not bonded or joined along the side seams 19, 39 and the seams 31, 32 but when unfolded with respect to the fold lines 54 and 55. However, FIG. 6 only serves illustrative purposes; the configuration shown in FIG. 6 does not occur during manufacture of the package according to the method of the present invention.

There, the two outer sections 61 and 62 correspond to the two outer layers of FIG. 5, whereas the inner sections 63 and 64 correspond to the two inner layers. FIG. 6 is only exemplary for illustration purpose. In a real life situation, the seams 31 and 32 are joined to each other and corresponding reinforcement structures 52 of the sections 61 and 63 as well as 62 and 64 are mutually joined or bonded.

The lines of weakness 15, 16 are symmetrically present in the two outer sections 61, 62 as well as in the two inner sections 63, 64. When the sections are mutually bonded and form various partially overlaying or overlapping layers 61, 62, 63, 64 the first line of weakness 15 extends into the seam 31 of the section 64 and the second line of weakness 16 extends into the seam 32 of the section 63. A third line of weakness 20 extends between the first and the second lines of weakness 15, 16. Alternatively, the three lines of weakness may also be interpreted as a single continuous line of weakness having a first, second and third section, 15, 16, 20. Upon filling of the package 60, 65, 1 the third line of weakness 20 extends within the internal panel 13 being almost entirely covered and overlaid by the external panel 14.

In the example of FIG. 4, the lines of weakness 15, 16 traverse the fold line 54. Insofar, in the fourfold portion 56, the lines of weakness 15, 16 comprise an upper straight section 27 as well as a lower bended section 28. In the illustrated embodiment, the lower residual part of the bended or curved section 28 of a line of weakness 15, 16 extends in the twofold portion 57 of the endless sheet. That part of the bended portion 28 of the lines of weakness 15, 16 extending in the fourfold portion 56 transforms into a peak portion 24 and a respective notch 23 in the internal panel 13 of the side wall 2.

The structure of reinforcement 52 may be of arbitrary shape. It can be oval, circular, or may have a straight shape. Further, the structure of reinforcement 52 should be disposed or arranged at a distance from the lateral edge 55 of the fourfold portion 56. The distance between the structural weakening 50 and the lateral edge 55 defines the height of the strap 49 of the second side wall 3 of the package 1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm," is intended to mean "about 40 mm".

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible package being capable of containing a multiplicity of articles, the package comprising a plurality of walls including first and second opposing side walls having respective first and second side seams, each side wall having an upper edge, a lower edge, and a pair of side edges, wherein at least a first gusset is formed in at least the first side wall, the first gusset comprising an internal panel and an external panel together forming a pocket, wherein at least the first side wall comprises a plurality of lines of weakness being at least partially formed in or through the external panel, wherein the lines of weakness of the first side wall are adapted to create an opening in the first side wall, the opening being confined by at least an upper section of the internal panel adjacent the upper edge and by at least one side section of the first side wall adjacent one of the side edges, wherein the upper section of the internal panel is bonded to the at least one side section of the first side wall at a location spaced from the first side seam, and spaced downwardly from the upper edge and spaced laterally inwardly from the one of the side edges, and wherein the at least one side section and the upper section of the internal panel form a frame adapted to engage and retain the articles inside the package after creation of the opening.

2. The package according to claim 1, wherein an edge of the upper section of the internal panel and an edge of the at least one side section of the first side wall are configured in an abutting relationship.

3. The package according to claim 1, wherein the upper section and the at least one side section are bonded along a seam extending from the opening towards one of the upper and side edges of the first side wall.

4. The package according to claim 3, wherein one of the lines of weakness extends to or across the bonded seam.

5. The package according to claim 3, wherein the bonded seam begins at an upper corner of the first side wall and extends into the first side seam of the first side wall, the first side seam lying substantially equidistant from the side edges of the first side wall.

6. The package according to claim 1, wherein a lateral extent of the upper edge of the external panel is smaller than the distance between the pair of side edges of the first side wall.

7. The package according to claim 1, wherein the external panel has an external panel side edge extending into the first side seam and being aligned with one of said lines of weakness.

8. The package according to claim 7, wherein the external panel comprises an inner layer and an outer layer, wherein the inner and outer layers are bonded or seamed along at least one of the external panel side edge and a foldline encompassing the first gusset and extending towards the lower edge of the first side wall.

9. The package according to claim 1, wherein the lines of weakness of the first side wall are substantially symmetric with respect to the first side seam of the first side wall and include first and second lines of weakness connected by a third line of weakness extending through the internal panel of the gusset.

10. The package according to claim 1, wherein the package comprises an aperture formed through the external panel.

11. The package according to claim 1, wherein at least a second gusset is formed in the second side wall, the second gusset comprising a second internal panel and a second external panel together forming a second pocket, wherein the second side wall comprises an aperture formed through the second external panel.

* * * * *